US005657812A

United States Patent [19]

Walter et al.

[11] Patent Number: 5,657,812

[45] Date of Patent: Aug. 19, 1997

[54] METAL-CASTING APPARATUS AND METHOD

[75] Inventors: Alfred Walter, Hanau; Hans-Jurgen Lau, Dreieich, both of Germany

[73] Assignee: Bachmann Giesserei und Formenbau GmbH & Co. KG, Frankfurt am Main, Germany

[21] Appl. No.: 558,167

[22] Filed: Nov. 13, 1995

[30] Foreign Application Priority Data

Nov. 15, 1994 [DE] Germany ..... 44 40 768.8

[51] Int. Cl.[6] ..... B22D 35/00

[52] U.S. Cl. ..... 164/113; 164/133; 164/316; 164/337

[58] Field of Search ..... 164/133, 335, 164/337, 113, 316; 222/385, 594, 596

[56] References Cited

U.S. PATENT DOCUMENTS 4,991,641 2/1991 Kidd et al. ..... 164/133

FOREIGN PATENT DOCUMENTS 24 38 060 2/1975 Germany .

26 48 730 5/1977 Germany .

2238497 6/1991 United Kingdom ..... 164/133

*Primary Examiner*—Kuang Y. Lin

*Attorney, Agent, or Firm*—Chilton, Alix & Van Kirk

[57] ABSTRACT

Apparatus for casting metals, especially alloys with low melting points, has a melt container which is connected to a mold via a casting line. A standpipe branches off from the casting line in the melt container. The melt is covered by an inert fluid blanket and the level of melt in the melt container is monitored and maintained such that at least a portion of the standpipe is surrounded by the melt. An overflow valve selectively opens or closes an overflow hole in the standpipe, the overflow hole being immersed in the inert fluid, to adjust the level of melt in the casting line.

19 Claims, 1 Drawing Sheet

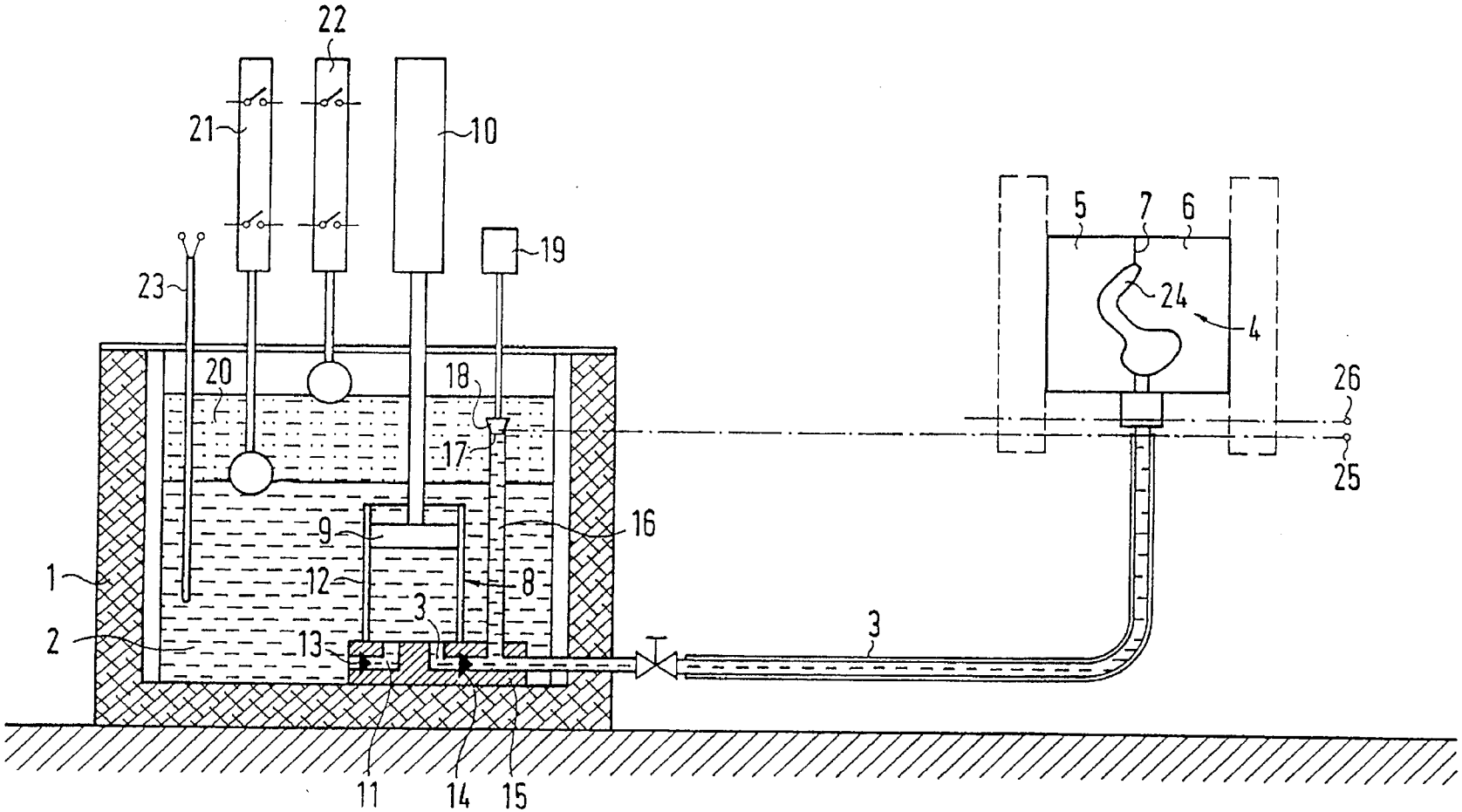
26
25
4
24
6
7
5
3
16
19
10
18
17
8
15
14
3
11
22
9
12
13
21
20
23
1
2

METAL-CASTING APPARATUS AND METHOD

BACKGROUND OF THE INVENTION

1. Field of the Invention

This invention relates to the casting of metals, especially metal alloys with low melting points. More particularly, the present invention is directed to apparatus for use in casting metals and especially apparatus having a melt container connected to a casting mold by a casting line. Accordingly, the general objects of the present invention are to provide novel and improved methods and apparatus of such character.

2. Description of the Prior Art

Casting methods and apparatus, wherein molten metal is conveyed from a furnace or melt container to a mold(s) via casting line(s), are known in the art and, for example, are used in the production of dead cores for plastic injection-molded parts, like those used in the automobile industry. Safety considerations dictate that molten metal not be allowed to free fall into an open mold. Accordingly, casting molds are usually filled from below through a pressurized casting line. The pressure in the line is maintained until the metal has completely hardened in the casting mold. In order to enable removal of the hardened part from the mold, or to change the tool, the connection between the casting line and the casting mold must be broken in a manner that prevents spillage of liquid metal in the line. At the same time, however, to save time for the next casting process and to avoid deposits on the walls of the casting line, the casting line should not be completely emptied. Accordingly, the vertical level of the molten metal in the casting line is adjusted so that it is stabilized at a height which is slightly below the dividing line between the casting mold and the casting line.

In the prior art, it is common practice for the metal level in the system to be established by means of a standpipe. An overflow hole, which can be opened by an overflow valve, is provided in the standpipe at a height corresponding to the desired level of the molten metal. After the end of the casting process, the overflow valve is opened to permit excess metal to flow off. The casting line and the standpipe are in fluid communication so that the level of metal in the casting line cannot fall below the level defined by the overflow hole in the standpipe. The melt is kept from flowing from the casting line back to its source, i.e., into the melt container, by a check valve.

The standpipe of the above-described prior art system is arranged outside the melt container. The standpipe must, accordingly, be heated to prevent the melt from hardening in the standpipe. Economics dictate that the melt flowing off through the overflow hole be fed back into the melt container. During the flow back to the melt container, the liquid metal comes into contact with air and may oxidize. Oxides delivered into the melt may have an adverse influence on the quality of the melt.

SUMMARY OF THE INVENTION

Briefly stated, the invention in a preferred form is a novel metal casting technique which allows adjustment of the level of metal in a casting system without having to utilize extra heating devices for the standpipe.

In apparatus in accordance with the invention, this novel method is implemented by placing the standpipe inside the melt container with part of its height being surrounded by the melt. The melt contained in the standpipe is thus automatically kept at the melt temperature, so that no additional heating devices are needed. In addition, excess molten metal from the standpipe is directly deposited into the melt container.

In a preferred embodiment, a blanket of an inert medium is provided over the melt in the melt container, and the overflow hole in the standpipe is maintained below the surface of the inert medium. This ensures that liquid metal flowing out the overflow hole does not come in contact with air, so that oxidation is prevented and optimal quality of the melt is guaranteed. Oxidation of the metal on the surface of the melt is prevented by the inert medium covering the melt.

Preferably, the inert medium is an inert liquid, for example glycol, since this makes handling much easier. As an alternative, an inert gas, for example nitrogen, can also be used.

To prevent the level of the inert medium in the melt container from falling so low over time that the overflow hole in the standpipe is above the surface of the inert medium, a fill status meter is provided in the melt container, by which the level of the melt and/or the inert medium can be determined. Metal is added to the melt to maintain the level of the inert medium, which floats on the melt, above the overflow hole.

To prevent loss, i.e., spillage, of the liquid metal when the connection between the casting mold and the casting line is broken, the level of the overflow hole of the standpipe is preferably at or somewhat below the height of the dividing line between the casting line and the casting mold.

In another embodiment, the length of the standpipe can be changed to make it fit various tool dimensions.

In one preferred embodiment of the invention, the overflow valve associated with the standpipe can be opened and closed in coordination with the casting process. Since there is reduced pressure in the casting line when the overflow valve is opened, the termination of the casting process can be controlled via the overflow valve.

Preferably, the overflow valve will be activated via a control device located outside of the melt container.

In the prior art, the melt is customarily fed to the casting mold from the melt container by a pump. The valves necessary for the pumping process are arranged in a valve unit, from which the casting line branches off. In accordance with the present invention, the standpipe also branches off from the casting line inside the valve unit, so that the standpipe, its associated overflow valve and the valve unit form a structural unit which can be premounted and used in the melt container.

BRIEF DESCRIPTION OF THE DRAWING

The present invention may be better understood, and its numerous objects and advantages will become apparent to those skilled in the art, by reference to the accompanying drawing which is a schematic representation of casting apparatus according to the invention.

DETAILED DESCRIPTION OF THE DISCLOSED EMBODIMENT

With reference to the drawing, a melt container in which a material to be cast is maintained in molten form is indicated at 1. In the disclosed embodiment a liquid metal 2, typically an alloy with a low melting point, is contained in melt container 1 which, for example, may be an insulated double-walled steel tank. The metal 2 is delivered to a casting mold, indicated generally at 4, through a flexible, heated casting line 3. The mold 4 is filled from the bottom to the top. The liquid metal 2 is injected into the casting mold 4 under pressure, and the air contained in the casting mold 4 escapes through a gap 7 between the halves 5, 6 of the mold or through a bleeder valve, not shown.

Molten metal 2 is withdrawn from melt container 1 and fed into casting mold 4 via casting line 3 by a metering pump indicated generally at 8. The metering pump 8 of the disclosed embodiment is designed as a piston pump having a piston 9 which is driven hydraulically, for example, via a controllable drive device 10 located outside of container 1. Liquid metal is drawn into the cylinder 12 of pump 8 through a suction duct 11, which is provided with a valve 13, by lifting the piston 9. The metal subsequently is injected into the casting line 3 and the casting mold 4 by closing valve 13 and driving piston 9 downwardly. The casting line 3 is provided with a check valve 14 so that, when the pressure is released, no melt can flow back into the melt container. The metering pump 8 and the accompanying valves 13, 14 are provided as a valve unit 15, which can be preassembled and used as a removable structural unit in a melt container 1.

A standpipe 16 branches off from casting line 3 at a point located upstream of the emergence of line 3 from valve unit 15, this point being within melt container 1. Accordingly, at least part of standpipe 16 is surrounded by the melt 2. This ensures that metal contained in the standpipe does not cool or harden. The standpipe 16 has an overflow hole 17 which can be opened and closed by an overflow or bypass valve 18. As will be explained below, the vertical position of hole 17 is critical. In a preferred embodiment, the overflow hole 17 is at the upper end of the standpipe 16. The overflow valve 18 is activated by a control device 19 positioned outside the melt container 1.

A blanket of inert fluid 20, for example a liquid such as glycol, covers the top surface of the liquid metal 2 in container 1 to prevent oxidation of the melt. Instead of a liquid blanket, a gas, preferably nitrogen, can be used. The thickness of blanket 20 is chosen such that the upper surface of the inert fluid is located above the overflow hole 17 in the standpipe 16. Fill status "meters" 21, 22 are provided to respectively monitor the level of the melt and the level of the inert liquid 20. The temperature of the melt is monitored by a temperature sensor 23.

To cast a part such as a core 24, the casting mold 4 is filled with liquid metal 2 from bottom to top by the metering pump 8 through the casting line 3. The casting pressure is maintained until the metal in the casting mold 4 has hardened. To remove the core 24 from the mold 4, or to change the tool, the connection between the casting line 3 and the casting mold 4 must be broken. To prevent the liquid metal 2 from flowing out of the end of casting line 3 upon breaking this connection, the level of the metal 25 in line 3 must be adjusted so as to lie somewhat below the dividing line 26 between the casting line 3 and the casting mold 4.

For this purpose, the overflow valve 18 in the standpipe 16 is opened to thereby cause a reduction in pressure in the casting line 3, whereby excess metal can flow back into the melt container 1 through the overflow hole 17. The standpipe 16 and the casting line 3 are in constant fluid communication and, accordingly, the level 25 of the molten metal in the casting line 3 is determined by the vertical position of the overflow hole 17. The length of the standpipe 16 can be changed or adjusted to relocate hole 17 to facilitate the manufacture of different parts. Restated, by adjustment of the length of the standpipe 16, the level 25 at which molten metal will be maintained in the casting line 3 can be set precisely to allow for longer or shorter molds. The metal is prevented from flowing back into the cylinder of pump 8 from line 3 by the check valve 14 in the valve unit 15.

Since the blanket of inert fluid 20 is provided over the liquid metal 2 in the melt container 1, and also extends over the overflow hole 17 in the standpipe 16, the metal coming out of the overflow hole 17 in the standpipe 16 cannot come in contact with air but, rather, flows back through the inert fluid 20 into the melt bath. This prevents oxidation of the metal returned from casting line 3, and the melt 2 retains the desired composition.

To prevent the level of the top surface of inert fluid blanket 20 from falling below the overflow hole 17, the level of the surfaces of metal 2 and inert liquid 20 are monitored by fill status meters 21, 22, so that more melt can be added when the level of the upper surface of blanket 20 drops close to the level of the overflow hole 17.

The invention thus allows the level 25 of the metal in the casting line 3, at the time the mold 4 is disconnected therefrom, to be maintained at the desired height in an uncomplicated manner. The invention also eliminates the need for a heat source for supplying additional heat for the standpipe 16. The invention additionally reliably prevents oxidation of molten metal fed back to the melt container through the overflow hole 17.

While a preferred embodiment has been shown and described, various modifications and substitutions may be made thereto without departing from the spirit and scope of the invention. Accordingly, it is to be understood that the present invention has been described by way of illustration and not limitation.

We claim:

1. A device for casting metals, especially alloys with low melting points, said device comprising:

container means for maintaining a supply of molten metal;

mold means for casting a part with the molten metal, said mold means defining at least a first mold cavity;

line means providing fluid communication between a first level of said container means and the bottom of said mold means cavity, said first level being below the bottom of said mold means cavity, said line means including first valve means for preventing back flow of molten metal from said mold means to said container means first level; and standpipe means in fluid communication with said line means on the mold means side of said first valve means, said standpipe means having an overflow opening and including second valve means for selectively opening and closing said overflow opening, said standpipe means being disposed in said container means whereby at least part of said standpipe means is surrounded by the molten metal, said overflow opening being disposed at a second level which is above said first level and below the bottom of said mold means cavity, opening and closing of said second valve means adjusting the level of the molten metal in said line means.

2. A device according to claim 1, further comprising a source of inert medium for providing a blanket of said inert medium in said container means above the molten metal contained therein, said blanket enveloping said overflow opening of said standpipe means.

3. A device according to claim 2, wherein said inert medium is a liquid.

4. A device according to claim 3, wherein said inert medium is glycol.

5. A device according to claim 2, wherein said inert medium is a gas.

6. A device according to claim 5, wherein said inert medium is nitrogen.

7. A device according to claim 2, further comprising means for monitoring the level of the surface of said inert medium.

8. A device according to claim 1, further comprising means for monitoring the level of the melt in said container means.

9. A device according to claim 1, wherein said line means and said mold means define a dividing line, said dividing line being disposed approximately at said second level.

10. A device according to claim 1, further comprising control means for controlling said second valve means, said control means being operable from outside said container means.

11. A device according to claim 1, further comprising:

pump means located in said container means for pumping the melt from said container means to said mold means; and a valve unit, said valve unit being located in said container means and comprising passageway means for selectively allowing the flow of molten metal into said pump means and from said pump means to said line means, said standpipe means being in fluid communication with said line means via said valve unit passageway means.

12. A device according to claim 7, further comprising means for monitoring the level of the melt in said container means.

13. A device according to claim 12, further comprising:

pump means located in said container means for pumping the melt from said container means to said mold means; and a valve unit, said valve unit being located in said container means and comprising passageway means for selectively allowing the flow of molten metal into said pump means and from said pump means to said line means, said standpipe means being in fluid communication with said line means via said valve unit passageway means.

14. A device according to claim 13, further comprising control means for controlling said second valve means, said control means being operable from outside said container means.

15. A casting method comprising the steps of:

a) melting a volume of the material to be cast in a melt container having an interiorly mounted vertically extending standpipe, the standpipe having a length, the volume of the molten material defining a height wherein at least a portion of the standpipe is surrounded by the molten material;

b) withdrawing a portion of the molten material from the melt container and injecting the withdrawn material into a mold cavity under pressure via a casting line wherein the mold cavity fills from the bottom up;

c) maintaining the casting line pressure while the material in the mold cavity hardens;

d) opening an overflow valve in the standpipe whereby excess molten material in the casting line feeds back to the melt container via an outlet in the standpipe until the level of material in the casting line reaches the level of the standpipe outlet;

e) disconnecting the mold from the casing line at a point above the level of molten material in the casting line; and f) removing the part from the mold.

16. The method of claim 15 wherein step a) further comprises creating a blanket of an inert fluid over the molten material in the melt container.

17. The method of claim 16 further comprising the steps of:

j) monitoring the level of the top surface of the blanket of inert fluid in the melt container; and k) adding molten material to the contents of the container when the monitored level reaches a predetermined level.

18. The method of claim 17 wherein the step of adding molten material is controlled to keep the standpipe outlet immersed in the inert fluid.

19. The method of claim 18 wherein the step of monitoring comprises measuring the level of the top surface of the molten material.

* * * * *